US009693607B2

(12) United States Patent
Imbriani

(10) Patent No.: US 9,693,607 B2
(45) Date of Patent: Jul. 4, 2017

(54) NECKLACE FOR STORING AND DISPENSING LOTION AND LIP BALM

(71) Applicant: Ralph Imbriani, St. Petersburg, FL (US)

(72) Inventor: Ralph Imbriani, St. Petersburg, FL (US)

( * ) Notice: Subject to any disclaimer, the term of this patent is extended or adjusted under 35 U.S.C. 154(b) by 16 days.

(21) Appl. No.: 14/931,273

(22) Filed: Nov. 3, 2015

(65) Prior Publication Data

US 2017/0119109 A1 May 4, 2017

(51) Int. Cl.

| | |
|---|---|
| ***A46B 5/02*** | (2006.01) |
| ***A44C 5/00*** | (2006.01) |
| ***A45D 40/24*** | (2006.01) |
| ***A45D 40/26*** | (2006.01) |
| ***B65D 37/00*** | (2006.01) |
| ***A44C 15/00*** | (2006.01) |
| *A45D 40/00* | (2006.01) |

(52) U.S. Cl.

CPC ..... *A44C 5/003* (2013.01); *A44C 15/002* (2013.01); *A45D 40/24* (2013.01); *A45D 40/26* (2013.01); *B65D 37/00* (2013.01); *A45D 2040/0012* (2013.01)

(58) Field of Classification Search

CPC ..... A44C 15/002; A44C 5/003; B65D 37/00
USPC ..... 401/6, 8; 63/1.14; 222/175; 224/148.2
See application file for complete search history.

(56) References Cited

U.S. PATENT DOCUMENTS 4,221,495 A * 9/1980 Braun ..... A45D 34/041 401/213
4,504,268 A 3/1985 Herlitze
4,768,688 A * 9/1988 Harrigan ..... A44C 5/003 206/37
5,244,135 A * 9/1993 Nelson ..... A45F 5/00 224/257
5,344,399 A 9/1994 DeVries
5,622,293 A * 4/1997 LeFevre ..... A44C 5/003 220/212
6,560,346 B2 5/2003 Ohta
6,581,811 B1 * 6/2003 Schillaci ..... A45F 3/16 220/666
7,316,332 B2 1/2008 Powers
7,766,193 B2 * 8/2010 Stollmann ..... A44C 5/003 222/175

(Continued)

FOREIGN PATENT DOCUMENTS

EP 2623431 7/2013
GB 204657 10/1923

(Continued)

*Primary Examiner* — Jennifer C Chiang

(74) *Attorney, Agent, or Firm* — Larson & Larson, P.A.; Justin P. Miller; Patrick A. Reid

(57) ABSTRACT

A device that allows a user to transport and store sunscreen and lip balm on their person.

The device is intended to be worn as a necklace or bracelet. The device includes two internal storage locations. The first storage location contains sunscreen, the second storage location contains a lip balm.

Alternatively, the device may be constructed as a single larger reservoir that is separated into individual storage locations using one or more dividing walls. For example, a large reservoir may be divided into a first reservoir, or primary reservoir, for the storage of sunscreen. On the opposite side of the dividing wall is a smaller storage location to store lip balm.

11 Claims, 3 Drawing Sheets

(56) References Cited

U.S. PATENT DOCUMENTS

| | | | | |
|---|---|---|---|---|
| 8,708,194 | B2 * | 4/2014 | Pascatore | B65D 83/005 222/1 |
| 8,950,632 | B2 * | 2/2015 | Ciavarella | A44C 5/0023 222/175 |
| 2009/0134184 | A1 | 5/2009 | Stollmann | |
| 2011/0127293 | A1 | 6/2011 | Pascatore | |

FOREIGN PATENT DOCUMENTS

| | | |
|---|---|---|
| GB | 2235861 | 3/1991 |
| WO | 2006/118479 | 9/2006 |

* cited by examiner

NECKLACE FOR STORING AND DISPENSING LOTION AND LIP BALM

FIELD

This invention relates to the field of personal storage of cosmetics and lotions—more particularly to a device for the storage and transportation of personal qualities of sunscreen and lip balm.

BACKGROUND

According to the Skin Cancer Foundation, skin cancer rates are increasing. Skin cancer affects many Americans—over the past three decades, more Americans were diagnosed with skin cancer than with all other cancers combined.

Using sunscreen is the best known way to prevent skin cancer. Research shows that regular use of sunscreen decreases the risk of skin cancer by 40-50 percent.

The lips are a particular area of concern, accounting for 10% of all skin cancer. This is a disproportionate amount, considering the relative size of one's lips as compared to the skin overall.

While using sunscreen to reduce the chance of skin cancer is simple, carrying sunscreen and lip balm is impractical. A backpack is not always available to store the sunscreen bottle and lip balm. This is particularly true when at a water park, public pool, or beach.

What is needed is a device that will allow a user to easily carry sunscreen and lip balm, resulting in greater use and decreased incidence of skin cancer.

SUMMARY

Disclosed within is a device that allows a user to transport and store sunscreen and lip balm.

The device disclosed within is intended to be worn as a necklace or bracelet. The device includes two internal storage locations. The first storage location contains sunscreen, the second storage location contains a lip protectant/lip balm.

Alternatively, the device may be constructed as a single larger reservoir that is separated into individual storage locations using one or more dividing walls. For example, a large reservoir may be divided into a first reservoir, or primary reservoir, for the storage of sunscreen. On the opposite side of the dividing wall is a smaller storage location to store lip protectant/lip balm.

The primary embodiment of the device is shaped as a long tube or elongated reservoir. This facilitates wearing the device as a necklace or bracelet. Optionally included in the wall of the tube is a filament, shape-retaining member/filament, or wire. The filament is a material that allows the user to bend the device to fit around the neck or wrist, and allows the device to maintain the desired shape. Anticipated materials include steel, aluminum, and other metals. But certain plastics may also be suitable for use.

The primary embodiment of the long tube includes two openings, one on each end—a proximal opening and a distal opening. Affixed to the proximal opening is a dispensing cap. The dispensing cap prevents the sunscreen from exiting the device while it is worn, but allows the user to access the sunscreen when needed.

The tube can be made of many flexible materials. Included are plastic, silicone rubber, natural rubber, neoprene, polyurethane, nylon, and related materials.

Further options include color. The tubing may be clear or translucent, allowing a user to view the contents. Or the tubing may be opaque. If the tubing is other than clear, colors may be chosen as desired for branding purposes, or to denote different types of enclosed product. For example, yellow may be used for sunscreen with a rating of SPF 15 and red for sunscreen with a rating of SPF 30. Or if the device is filled with liquids other than sunscreen, one may use colors to indicate contents. For example, blue for hand lotion and green for shampoo.

The distal opening is terminated by a rounded or dome-shaped lip balm applicator. Contained within the lip balm chamber is a lip protectant, such as petroleum jelly. The user can squeeze the body of the device to push the lip protectant through the lip balm orifice.

The disclosed device is anticipated as a single-use item, or as a refillable item.

As a single-use item, the device is sold filled with both sunscreen and lip balm. Optional color-coding is applied to indicate the strength of the contained sunscreen. The device contains a quantity of sunscreen required by a single user for a day of sun exposure. The item is purchased, used throughout the day, and discarded when empty.

As a refillable item, the device may be sold with or without contained sunscreen. The user may refill the device by removing the dispensing cap and forcing sunscreen back into the device. Sunscreen is then used as needed, and the device is refilled as needed. The lip protectant may also be refillable. In this embodiment color-coding may be inappropriate, given that the user may fill the device with any strength of sunscreen.

In other embodiments the distal opening includes a cap. The distal opening cap is useful to maintain cleanliness of the lip balm applicator.

BRIEF DESCRIPTION OF THE DRAWINGS

The invention can be best understood by those having ordinary skill in the art by reference to the following detailed description when considered in conjunction with the accompanying drawings in which.

DETAILED DESCRIPTION

Figure 1:
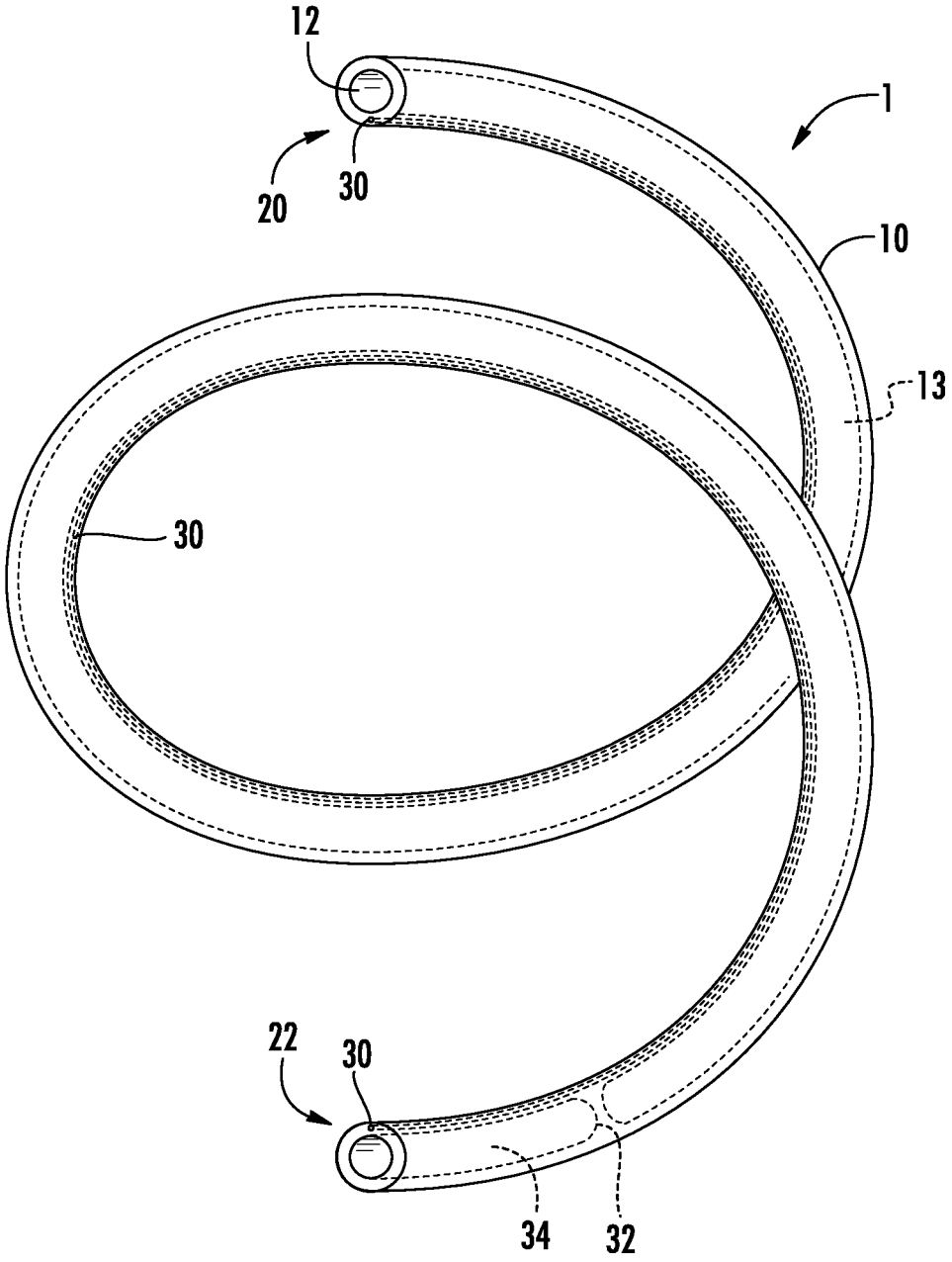
FIG. 1 illustrates a view of the body of the device without a dispensing cap or lip balm.

Reference will now be made in detail to the presently preferred embodiments of the invention, examples of which are illustrated in the accompanying drawings. Throughout the following detailed description, the same reference numerals refer to the same elements in all figures.

Referring to FIG. 1, a view of the body of the sunscreen necklace 1, without a dispensing cap or lip balm, is shown. The sunscreen necklace 1 is shown with a body 10. Passing through the body 10 is bore 12, which passes through most or all of the body 10.

The body 10 ends in two openings, a proximal opening 20 and a distal opening 22. The distal opening 22 leads to the lip balm chamber 34, which is separated from the sunscreen chamber 13 by dividing wall 32.

Figure 2:
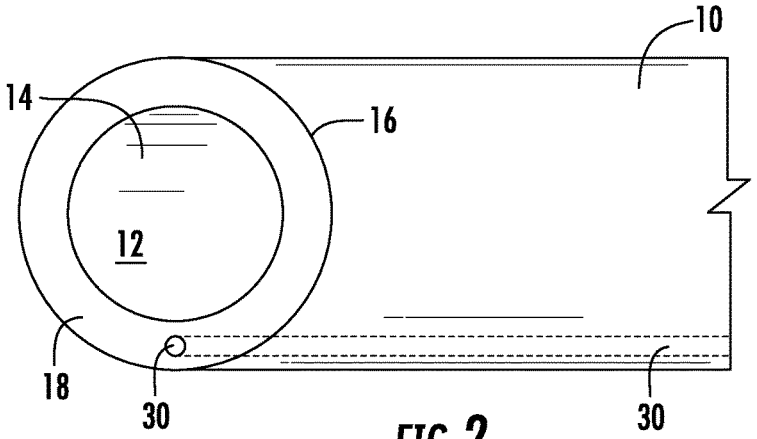
FIG. 2 illustrates an exploded view of one end of the device.

Referring to FIG. 2, an exploded view of one end of the sunscreen necklace 1 is shown. The bore 12 passes through the body 10. This creates an inner surface 14 and an outer surface 16 that are separated by a wall 18. Contained within the wall 18 is one or more filaments 30. Given that the body 10 is preferably constructed of a flexible material that does not maintain a shape, the filaments 30 act to hold the shape of the sunscreen necklace 1 for use as a necklace or bracelet.

Figure 3:
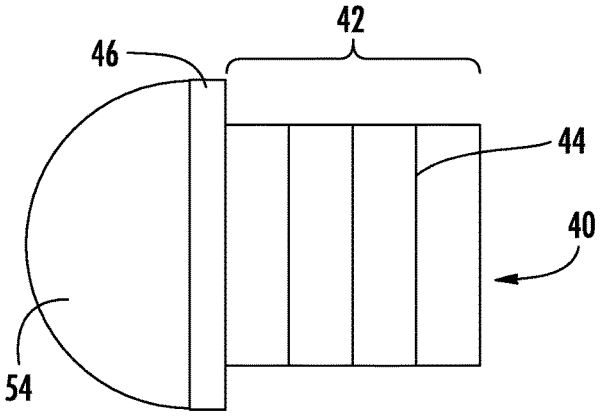
FIG. 3 illustrates a cap in a closed position.

Referring to FIG. 3, a dispensing cap 40 in a closed position is shown. The dispensing cap 40 includes a protrusion 42 for insertion into the bore 12 of the body 10. The protrusion optionally includes ribs 44 that prevent the dispensing cap 40 from inadvertently detaching from the body 10.

Connected or integral to the protrusion 42 is flange 46. Flange 46 seals against lid 54, sealing in the sunscreen contained within the bore 12 during storage and transportation of the sunscreen necklace 1.

Figure 4:
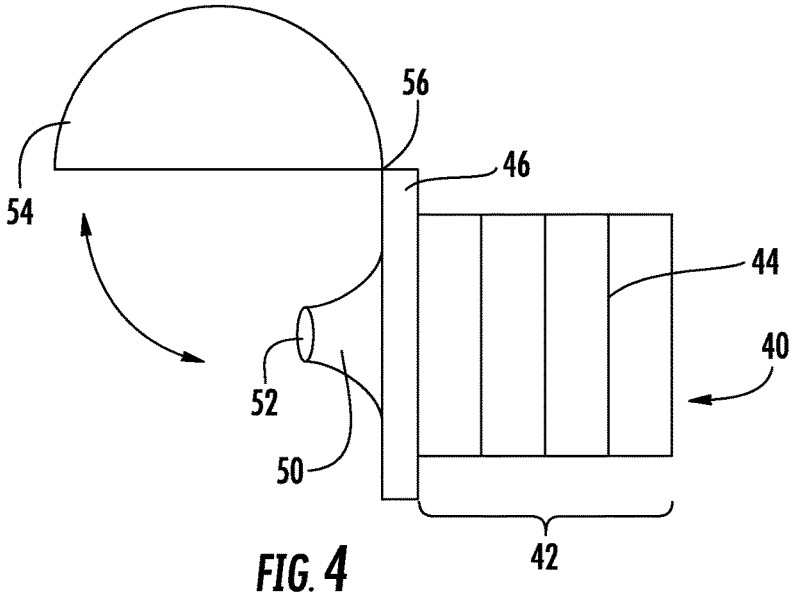
FIG. 4 illustrates a cap in an open position.

Referring to FIG. 4, a dispensing cap 40 in an open position is shown. The lid 54 is open, bending along hinge 56. The open cap 54 exposes spout 50 with orifice 52.

Figure 5:
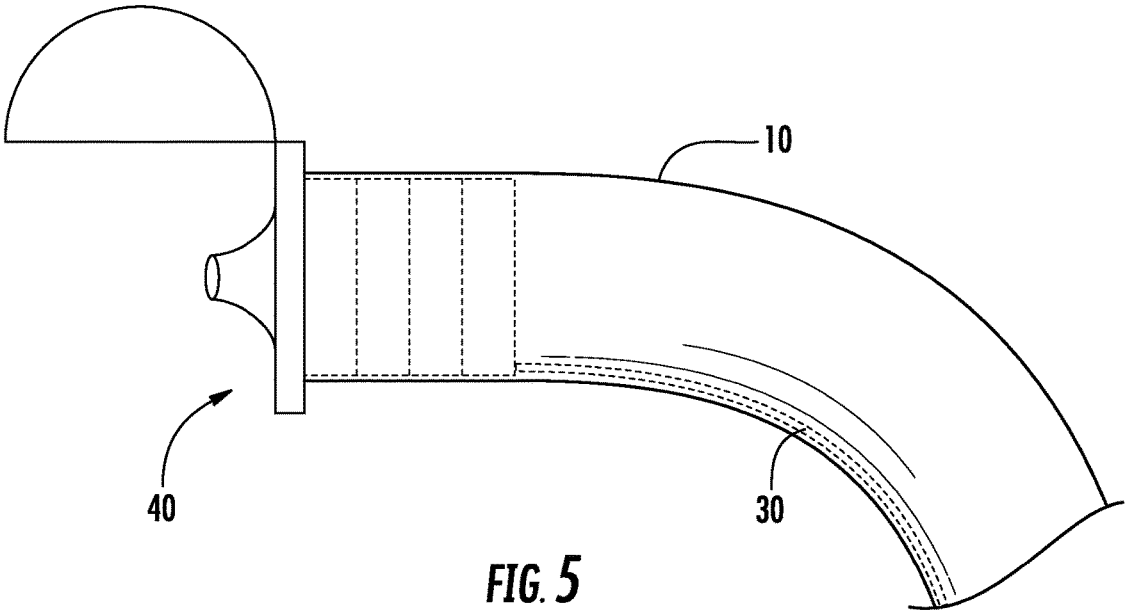
FIG. 5 illustrates a cap in an open position affixed to the body of the device.

Referring to FIG. 5, a cap in an open position affixed to the body 10 of the sunscreen necklace 1 is shown. The body 10 is flexible and compressible, allowing the user to squeeze the body 10 to push the contained sunscreen out of the dispensing cap 40.

Figure 6:
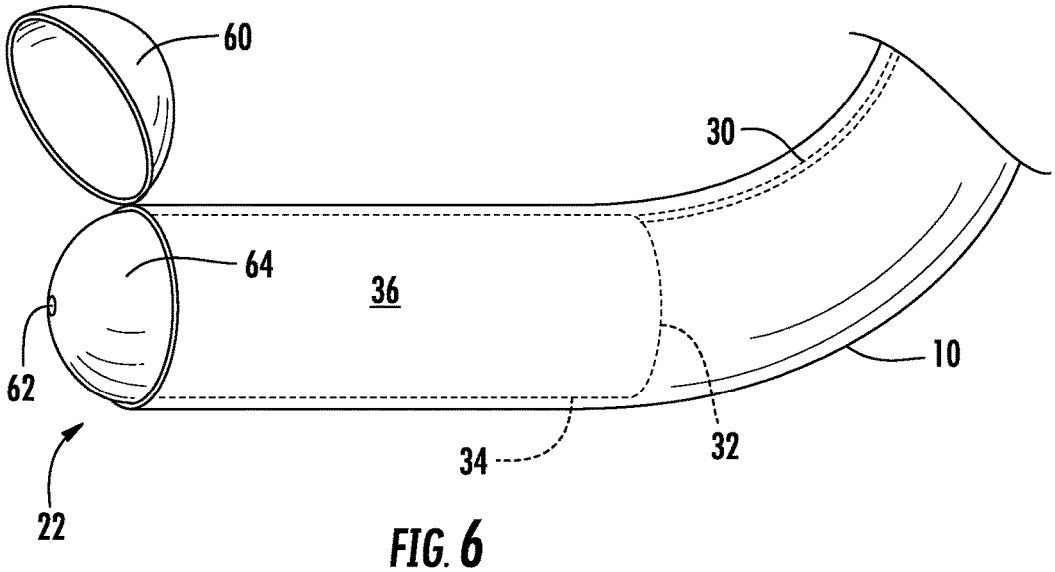
FIG. 6 illustrates a lip balm chamber and applicator.

Referring to FIG. 6, a lip balm storage location is shown. A lip balm cap 60 optionally covers a lip balm applicator 64, with a central lip balm orifice 62. The lip balm cap 60 connects to distal opening 22. Contained within the lip balm chamber 34 is a lip protectant 36, which is any substance useful for protecting lips. For example, petroleum jelly.

The lip balm chamber 34 is separated from the sunscreen chamber 13 by the dividing wall 32.

Equivalent elements can be substituted for the ones set forth above such that they perform in substantially the same manner in substantially the same way for achieving substantially the same result.

It is believed that the system and method as described and many of its attendant advantages will be understood by the foregoing description. It is also believed that it will be apparent that various changes may be made in the form, construction and arrangement of the components thereof without departing from the scope and spirit of the invention or without sacrificing all of its material advantages. The form herein before described being merely exemplary and explanatory embodiment thereof. It is the intention of the following claims to encompass and include such changes.

What is claimed is:

1. A device to store and transport sunscreen and lip balm, the device comprising:

a. an elongated body having an inner surface, an outer surface, a wall separating the inner surface and outer surface, a proximal opening, and a distal opening;

b. a primary storage reservoir within the elongated body to contain the sunscreen, the primary storage location in communication with the proximal opening;

c. a secondary storage reservoir within the elongated body to contain the lip balm, the secondary storage reservoir in communication with the distal opening; and d. a shape-retaining metal wire within the wall of the elongated body.

2. The device to store and transport sunscreen and lip balm of claim 1, wherein the primary storage reservoir and secondary storage reservoir are separated by a dividing wall.

3. The device to store and transport sunscreen and lip balm of claim 1, further comprising:

a. a closeable dispensing cap connected to the proximal opening of the elongated body.

4. The device to store and transport sunscreen and lip balm of claim 2, further comprising:

a. a dome-shaped lip balm applicator connected to the distal opening, the dome-shaped lip balm applicator for use applying lip balm to a user's lips; and b. a closeable dispensing cap covering the dome-shaped lip balm applicator.

5. The device to store and transport sunscreen and lip balm of claim 1, wherein the elongated body is a soft material, allowing a user to squeeze the elongated body to dispense sunscreen.

6. A sunscreen storage device comprising:

a. an elongated reservoir with an inner surface, an outer surface, a wall separating the inner surface and outer surface, and an internal dividing wall;

b. the internal dividing wall separating the elongated reservoir into first and second compartments;

c. the first compartment for storing sunscreen;

d. the second compartment for storing lip balm;

e. a shape-retaining metal wire within the wall of the elongated reservoir;

f. a dome-shaped lip balm applicator connected to the distal opening of the elongated reservoir, the dome-shaped lip balm applicator for use applying lip balm to a user's lips; and g. a closeable dispensing cap connected to the proximal opening of the elongated reservoir;

i. the closeable dispensing cap comprising:

1. a flange to separate the cap from the elongated reservoir;

2. a spout through which sunscreen can pass; and 3. a lid hinged to the flange.

7. The sunscreen storage device of claim 6 further comprising:

a. a shape-retaining filament integral to the elongated reservoir.

8. The sunscreen storage device of claim 6 a. wherein the elongated reservoir is a soft material, allowing a user to squeeze the elongated reservoir to dispense sunscreen.

9. A device to store an individual quantity of sunscreen and lip balm consisting of:

a. a tube with an internal reservoir, the tube including a shape-maintaining metal wire;

b. the internal reservoir divided into a first reservoir and a second reservoir;

c. the first reservoir for storage of sunscreen, the second reservoir for storage of lip balm;

d. a dividing wall between the first reservoir and the second reservoir to maintain separation of the sunscreen and lip balm; and e. a dome-shaped lip balm applicator connected to the second reservoir, the dome-shaped lip balm applicator for use applying lip balm to a user's lips.

10. The device to store an individual quantity of sunscreen and lip balm of claim 9 wherein the first reservoir is terminated by a cap and the second reservoir is terminated by a cap.

11. The device to store an individual quantity of sunscreen and lip balm of claim 9 wherein the tube is colored to indicate a strength of sunscreen.

* * * * *